US006234223B1

(12) United States Patent
Nelson

(10) Patent No.: US 6,234,223 B1
(45) **Date of Patent: *May 22, 2001**

(54) CARBONATED BEVERAGE AND ICE DISPENSING SYSTEM

(75) Inventor: Patrick L. Nelson, Sun Prairie, WI (US)

(73) Assignee: Dispensing Systems, Inc., Madison, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/489,692

(22) Filed: Jan. 24, 2000

(51) Int. Cl.[7] ..... B65B 1/04

(52) U.S. Cl. ..... 141/264; 141/2; 141/18; 141/301; 222/146.6

(58) Field of Search ..... 141/263, 264, 141/253–255, 267, 270, 275–278, 351, 356, 369, 374, 94, 198, 98, 2, 18, 301; 222/146.6

(56) References Cited

U.S. PATENT DOCUMENTS

| | | | |
|---|---|---|---|
| 2,380,884 | 7/1945 | Stoeser et al. | 225/21 |
| 2,893,444 | 7/1959 | Waddington et al. | 141/89 |
| 3,047,033 | 7/1962 | Rosen | 141/284 |
| 3,252,654 | 5/1966 | Deutch | 235/94 |
| 3,718,233 | 2/1973 | Nordhoff | 222/70 |
| 4,202,387 | 5/1980 | Upton | 141/360 |
| 4,333,504 | 6/1982 | Golding | 141/55 |
| 4,360,128 | 11/1982 | Neumann | 222/26 |
| 4,675,660 | 6/1987 | Boscolo | 340/612 |
| 4,685,598 | 8/1987 | Nezworski | 222/400 |
| 4,715,414 | 12/1987 | Harrison et al. | 141/302 |
| 4,737,037 | 4/1988 | Mojonnier | 366/152 |
| 4,744,395 | 5/1988 | Ziegler | 141/95 |
| 4,762,251 | 8/1988 | Berger | 222/49 |
| 4,895,194 | 1/1990 | McCann et al. | 141/198 |
| 4,949,764 | 8/1990 | Clüsserath | 141/6 |
| 4,976,295 | 12/1990 | Clüsserath | 161/39 |
| 5,129,548 | 7/1992 | Wisiewski | 222/16 |
| 5,163,582 | 11/1992 | Godolphin et al. | 222/1 |
| 5,203,474 | 4/1993 | Haynes | 222/129 |
| 5,219,008 | 6/1993 | Shannon | 141/83 |
| 5,228,486 | 7/1993 | Henninger | 141/95 |
| 5,268,849 | 12/1993 | Howlett et al. | 365/478 |
| 5,566,732 | 10/1996 | Nelson | 141/94 |
| 5,603,363 | 2/1997 | Nelson | 141/351 |

*Primary Examiner*—Steven O. Douglas
(74) *Attorney, Agent, or Firm*—Quarles & Brady LLP; George E. Haas

(57) ABSTRACT

A system for dispensing carbonated beverage and ice into an open container uses a bottom filling technique in which the outlet port of the nozzle is proximate to a bottom of the open container in order to dispense the carbonated beverage. Preferably, the carbonated beverage is maintained in a pressurized state within the nozzle until immediately prior to opening the valve in order to maintain appropriate carbonation of the beverage. It is preferred that ice be added after the nozzle is located proximate the bottom of the open container. The ice dispenser includes a funnel located concentrically around the nozzle in order to supply ice around the nozzle into the open container. In order to avoid excessive foaming, it is important that the temperature of the carbonated beverage be chilled to approximately the surface temperature of the ice being added into the open container.

5 Claims, 8 Drawing Sheets

FIG. 7
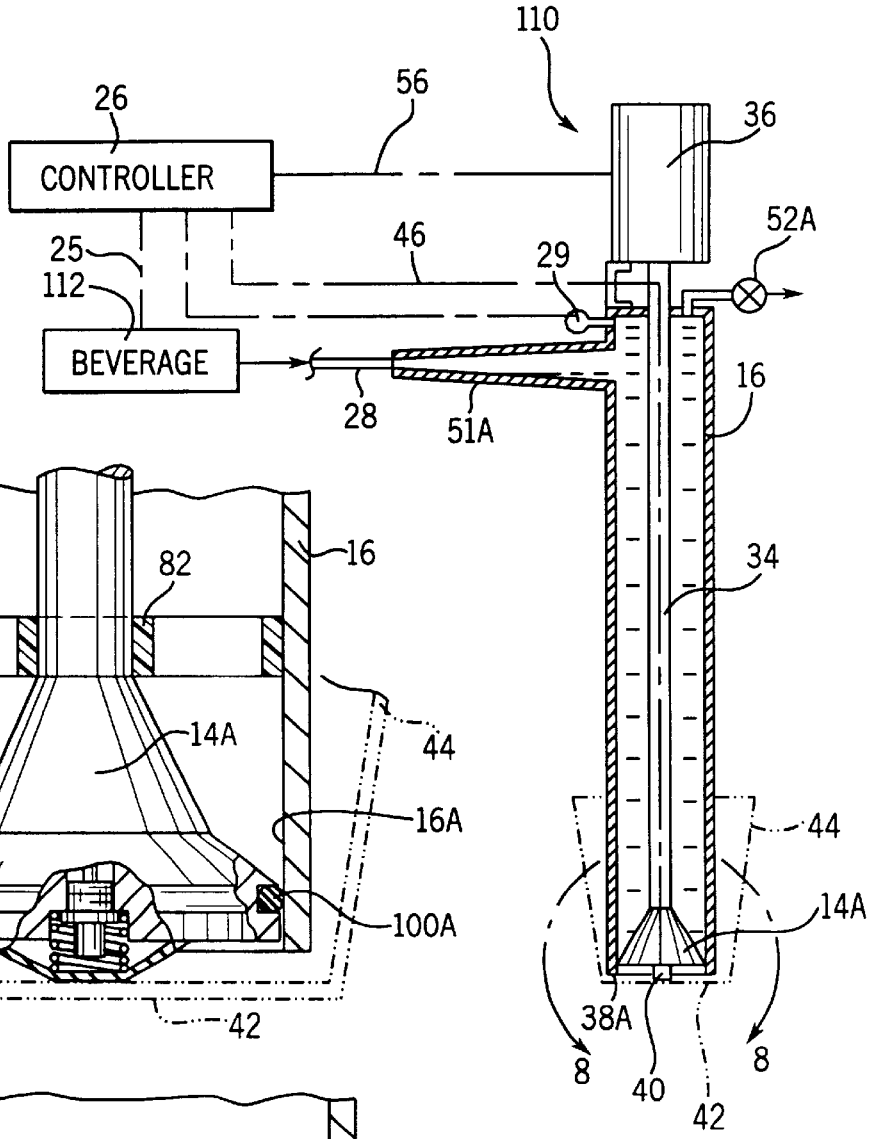
FIG. 8
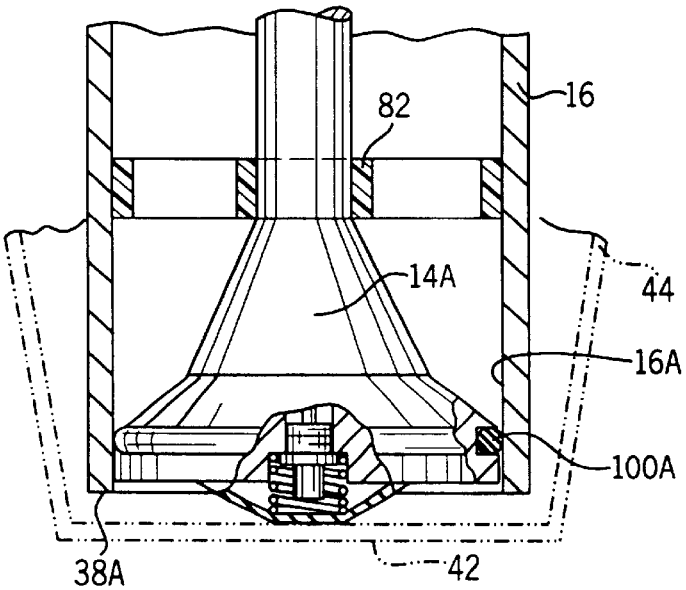
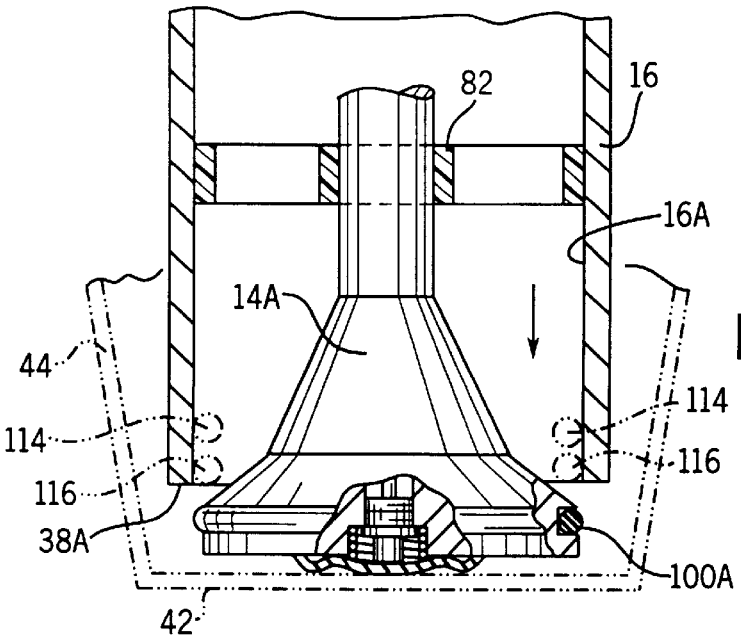
FIG. 9

FIG. 10
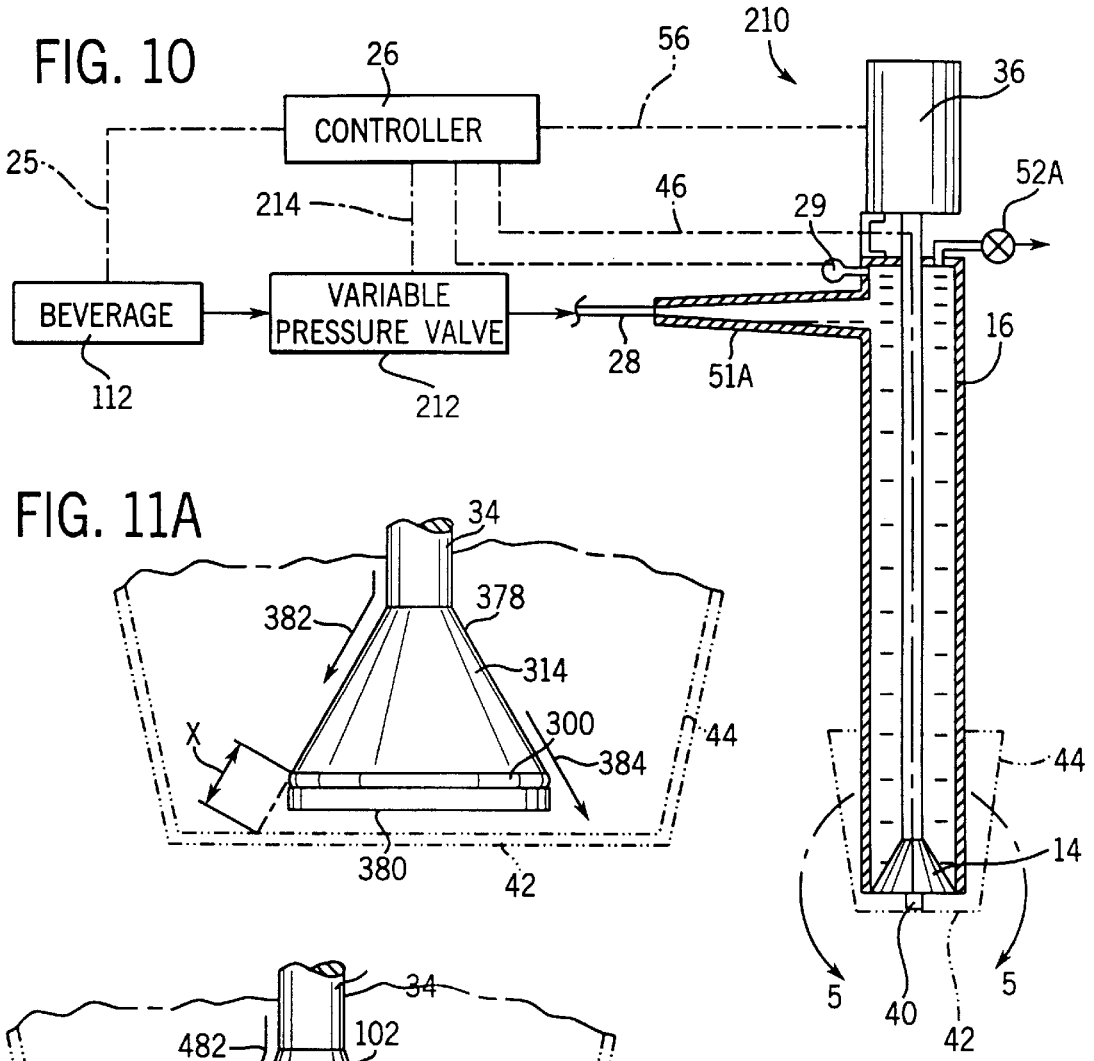
FIG. 11A
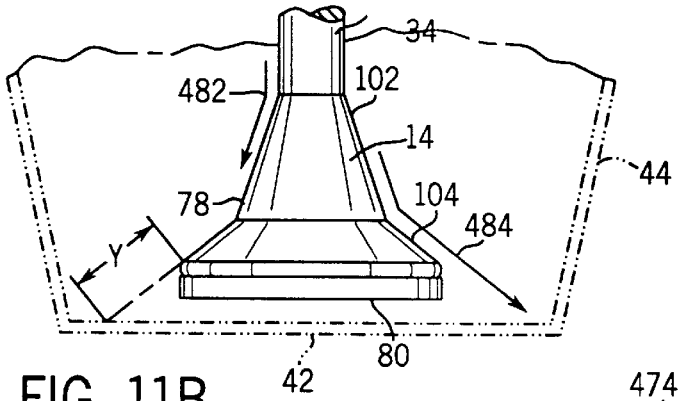
FIG. 11B
FIG. 11C
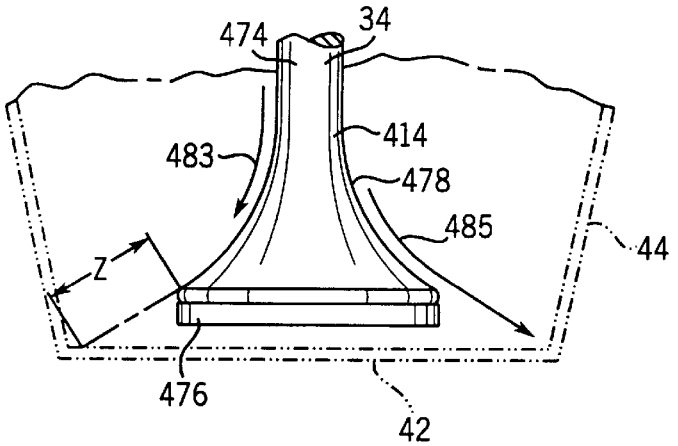

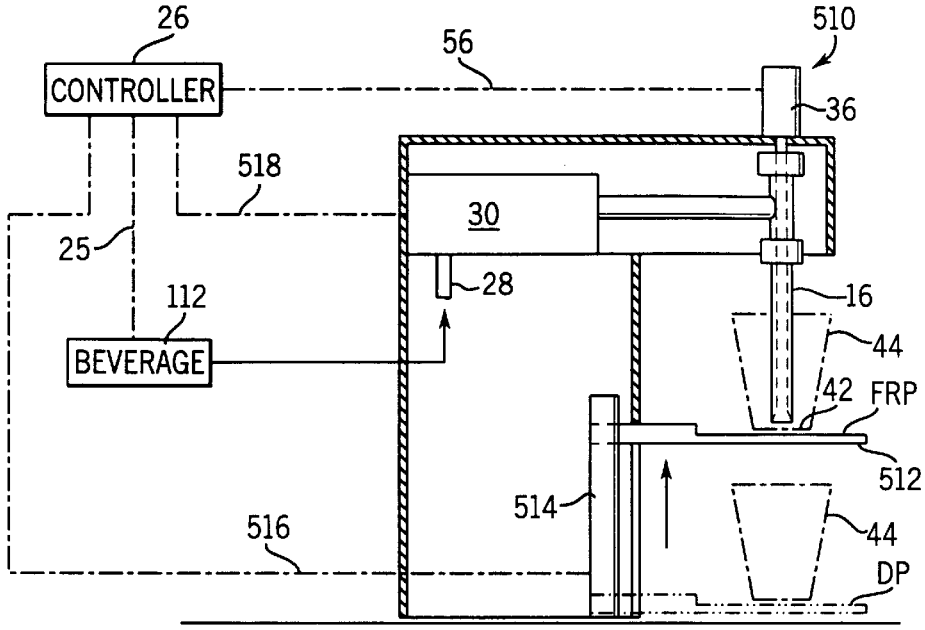
FIG. 12
FIG. 13
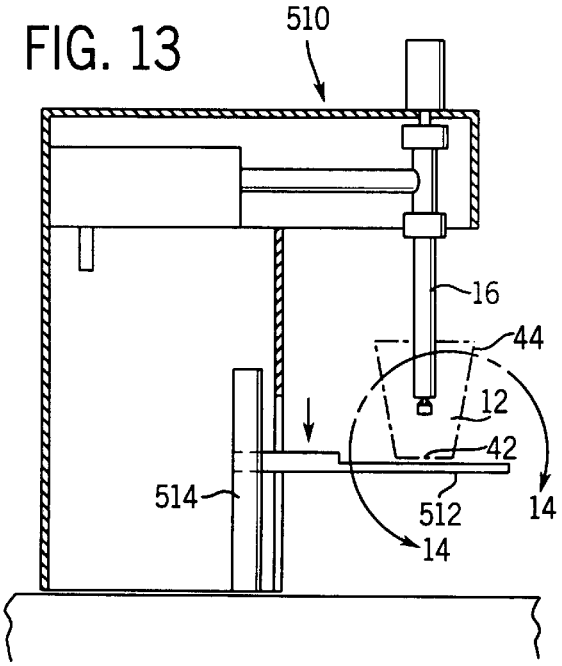
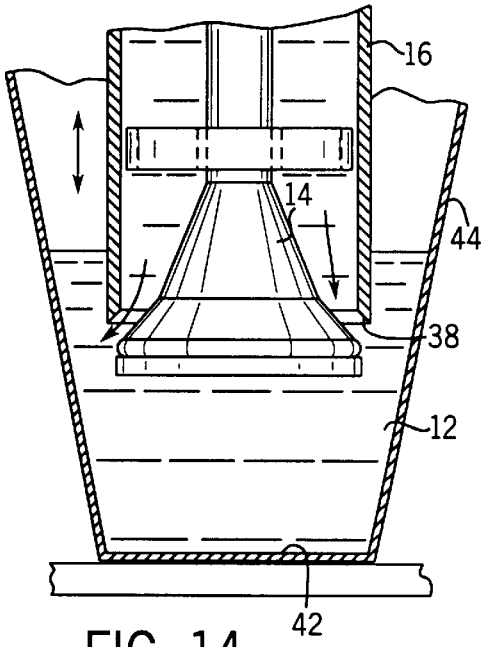
FIG. 14

CARBONATED BEVERAGE AND ICE DISPENSING SYSTEM

BACKGROUND OF THE INVENTION

The invention relates to the automated dispensing of a carbonated beverage into open containers.

The present invention arose during ongoing efforts by the inventor to improve carbonated beverage dispensing systems. In U.S. Pat. No. 5,603,363 entitled "Apparatus For Dispensing A Carbonated Beverage With Minimal Foaming", issuing on Feb. 18, 1997, and in U.S. Pat. No. 5,566,732 issuing on Oct. 22, 1996, both incorporated herein by reference, the inventor discloses systems for dispensing carbonated beverage, such as beer or soda, into an open container. The system disclosed in U.S. Pat. 5,603,363 discloses the bottom filling of carbonated beverage into an open container. U.S. Pat. No. 5,566,732 discloses the use of a bar code reader to read indicia on the open container when placed beneath the nozzle that indicates the volume of the open container in order to automate the dispensing procedure, and preferably various aspects of on site accounting and inventory procedures. In these systems, the carbonated beverage is dispensed from a nozzle that has an outlet port placed near the bottom of the open container, i.e. the open container is bottom filled.

As discussed in the above incorporated patents, carbonated beverage often foams while being dispensed into the serving container using conventional filling dispensing systems. This is particularly true when ice and carbonated soft drinks are dispensed into an open container. As a consequence, personnel operating the dispenser must fill the serving container until the level of foam reaches the brim and then wait for the foam to settle before adding additional carbonated beverage. In some instances, several iterations of this process must occur before the container is filled with liquid to the proper serving level. "Topping Off" necessitated by the foaming of the beverage prolongs the dispensing operation and impedes the ability to fully automate the dispensing of the carbonated soft drink. Nevertheless, many establishments have push button activated taps that automatically dispense measured quantities of carbonated beverage. Normally, this automated equipment only partially fills the serving container and the user must still manually "top off" the container after the foam from the automated step settles in order to dispense the proper serving quantity.

SUMMARY OF THE INVENTION

The invention is an automated carbonated beverage and ice dispensing system and method. The invention uses a bottom filling technique for the carbonated beverage, and also provides an efficient manner of adding ice to an open container of carbonated beverage.

In its preferred aspect, the invention involves the step of adding ice to the open container after the open container is placed underneath the nozzle such that the outlet port of the nozzle is proximate the bottom of the open container when the ice is being added to the container. Preferably, the ice is supplied to the open container through a funnel having a outlet through which the downwardly extending carbonated beverage nozzle extends. The ice is supplied circumferentially around the nozzle and into the open container. In order to reduce foaming, the carbonated beverage should be chilled prior to dispensing to a temperature that approximately matches the surface temperature of the ice. Preferably, the invention maintains the carbonated beverage in a pressurized state until immediately prior to dispensing the carbonated beverage, which is desirable in order to control the amount of carbonation within the beverage prior to dispensing the beverage.

Other features and advantages of the invention should be apparent to those skilled in the art upon inspecting the drawings and reviewing the following description thereof.

BRIEF DESCRIPTION OF THE DRAWINGS

FIG. 7 is a schematic view of another embodiment of the invention.

FIG. 8 is a detailed view of the region in FIG. 7 designated by arrows 8—8 which illustrates the valve head configuration of the system in FIG. 7.

FIG. 9 is a view similar to FIG. 8 showing a bottom activation switch being actuated in order to open the valve and dispense carbonated beverage from the nozzle into the open container.

FIG. 10 is a schematic view of another embodiment of the invention.

FIGS. 11A through 11C show various embodiments of valve heads, each having a distinct configuration for the distribution surface on the valve head.

FIG. 12 is a schematic drawing showing an automated open container holder.

FIG. 13 is a schematic view similar to FIG. 12 which shows the open container being automatically lowered as it is being filled.

FIG. 14 is a detailed view of the region depicted by arrows 14—14 in FIG. 13.

DETAILED DESCRIPTION OF THE INVENTION

Figure 1:
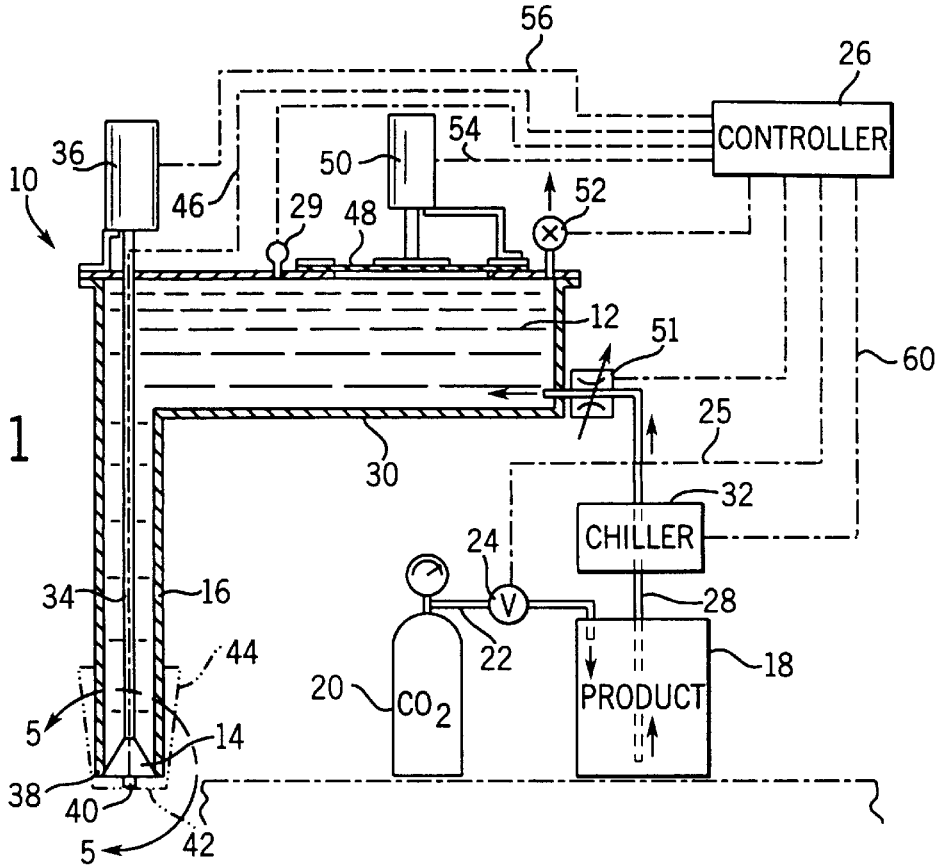
FIG. 1 is a schematic view of a carbonated beverage dispensing system in accordance with a first embodiment of the invention.

FIG. 1 illustrates a carbonated beverage dispensing system 10 that maintains the carbonated beverage 12 in a pressurized state, i.e. at a pressure substantially above atmospheric pressure such as 15 psi, when the valve 14 for the dispensing nozzle 16 is in a closed position. In FIG. 1, the source of carbonated beverage is designated by reference numeral 18. A carbon dioxide source 20 is connected to the source of carbonated beverage 18 via line 22 in order to supply gas that forces the carbonated beverage out of the source container 18 as is common practice. The source container 18 would typically be a keg of malt beverage such as beer, or could be a source of carbonated water to which flavored syrup is mixed downstream in the case of soft drinks. FIG. 1 shows a valve 24 in line 22 that is electronically controlled by controller 26 in order to regulate the pressure within the source 18 of carbonated beverage. Alternatively, the system pressure is set manually, or by a conventional regulator on the carbon dioxide source.

The pressurized carbonated beverage is supplied from the source 18 of carbonated beverage through line 28 to a pressurized chamber 30. Pressure transducer 29 monitors the pressure of the carbonated beverage within the pressurized chamber 30 and dispensing nozzle 16, and outputs a signal to the electronic controller 26. An in-line chiller 32 chills the carbonated beverage flowing through line 28 to a desired temperature. The in-line chiller 32 is controlled by the electronic controller 26. As described later in connection with FIG. 3, the chiller 32 is preferably a zero$\Delta$T freon bath chiller. The volume of the pressurized chamber 30 is relatively arbitrary, but in this embodiment is approximately one gallon. The dispensing nozzle 16 extends downward from the pressurized chamber 30. The dispensing nozzle preferably has a diameter of ¾ to 2 inches, and has a length sufficient for bottom filling open containers which are typically used in connection with the system 10. For example, the nozzle 16 may typically be 12 or more inches in length.

The valve head 14 is connected to a valve stem 34 which passes longitudinally along the center axis of the nozzle 16 and extends upward through the pressurized chamber 30. An electronically controlled actuator 36, such as a servo motor or a pneumatic actuator, is mounted to the top of the chamber 30. The valve actuator 36 is connected to the valve stem 34 and selectively positions the valve head 14 with respect to the outlet port 38 of the nozzle 16. The electronic controller 26 outputs a control a signal to the valve actuator 36 through line 56. In the system shown in FIG. 1, a bottom activation switch 40 is provided along a base surface of the valve 14. When the bottom 42 of the open container 44 presses the switch 40 upward, the switch 40 sends a signal through line 46 physically located in part within the valve stem 34 to the electronic controller 36.

Figure 2:
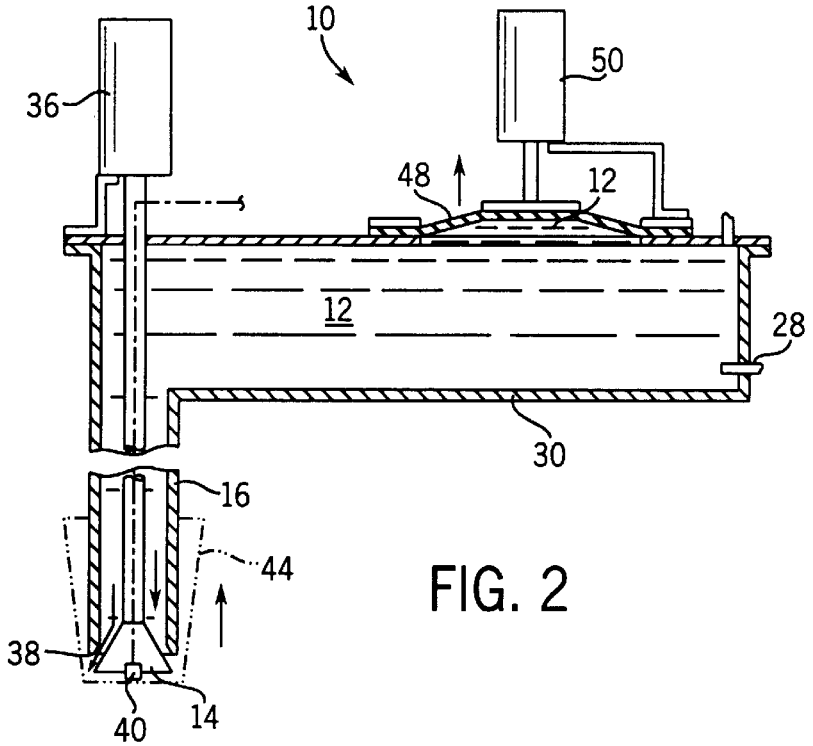
FIG. 2 is a view of a portion of the carbonated beverage dispensing system shown in FIG. 1 at a point in time in which carbonated beverage is dispensing from the system into an open container.

The system 10 also preferably includes an elastomeric bladder 48 mounted along one of the surfaces of the pressurized chamber 30. A bladder actuator 50, such as a servo motor or a pneumatic actuator, is connected to the elastomeric bladder 48. As depicted in FIGS. 1 and 2, the bladder 48 is in contact with the carbonated beverage 12 in the pressurized chamber 30. During operation of the system 10, the electronic controller 26 controls the actuator 50 to move the elastomeric bladder 48 from the position shown at FIG. 1 to the position shown in FIG. 2. In the retracted position in FIG. 2, the pressure of the carbonated beverage within the chamber 30 and the nozzle 16 is reduced to a selected pressure in order to dispense the carbonated beverage through the outlet port 38 of the nozzle 16. FIG. 1 also shows an adjustable flow restriction device 51 located in pressurized line 28 between the source 18 of the pressurized carbonated beverage and the chamber 30 and nozzle 16. One purpose of the adjustable flow restriction device 51 is to create a time lag for the recovery of pressure within the nozzle 16 after the bladder 48 has been retracted. Another purpose is to maintain appropriate carbonation of the beverage upstream of the flow restriction device 51.

An electronically controlled venting valve 52 is mounted to the pressurized chamber 30. The venting valve 52 is opened in order to fill the pressurized chamber 30 and nozzle 16 with carbonated beverage during start up.

The system 10 shown in FIGS. 1 and 2 operates generally in the following manner. The electronic controller 26 adjusts valve 24 in pressurized carbon dioxide line 22 in order to force carbonated beverage from the source 18 into pressurized line 28 or, as mentioned, the initial system pressure can be set manually or by a conventional regulator on the carbon dioxide source. A typical pressure for pressurized line 28 would be 15–30 psi, although this pressure is discretionary. The in-line chiller 32 chills the pressurized carbonated beverage to a desired temperature (for example, 36.5 degrees Fahrenheit for certain beers, or the surface temperature of ice added to the open container for soft drinks). The chilled and pressurized carbonated beverage then flows through the flow restriction device 51 and into the pressurized chamber 30 and nozzle 16 with the valve 14 in a closed position as shown in FIG. 1. With the valve 14 closed, the pressure of the carbonated beverage in the nozzle achieves equilibrium pressure which is the same as the pressure in the pressurized line 28 and substantially greater than atmospheric pressure.

In order to dispense carbonated beverage into the open container 44, the open container 44 is placed underneath the nozzle 16 with the outlet port 38 for the nozzle 16 proximate the bottom 42 of the open container 44. The system 10 is then activated to initiate a dispensing cycle, for example by pushing the bottom 42 of the open container 44 against the activation switch 40 on the bottom of the valve head 14, or in accordance with a barcode system such as disclosed in incorporated U.S. Pat. No. 5,566,732, or by some other push button or electronic control. After system activation, the dispensing valve 14 is maintained in a closed position and the electronic controller 26 initiates the dispensing cycle. First, the electronic controller sends a control signal through line 54 to the bladder actuator 50 to retract the elastomeric bladder 48 and reduce the pressure of the carbonated beverage 12 contained in the nozzle 16 and chamber 30 to a lesser pressure that is appropriate for controlled dispensing of the carbonated beverage from the outlet port 38 of the nozzle 16 into the open container 44. Preferably, the retraction of the bladder 48, FIG. 2, reduces the pressure of the carbonated beverage 12 in the nozzle 16 to a pressure slightly greater than atmospheric pressure, and in any event no more than 6 psi greater than atmospheric pressure. The valve head 14 is opened once the pressure of the carbonated beverage has been reduced to the selected dispensing pressure, thus allowing carbonated beverage to flow from the nozzle outlet port 38 into the open container 44 in a controlled manner as illustrated in FIG. 2. Because the pressure of the carbonated beverage is known during the dispensing procedure, the amount of carbonated beverage filling the open container 44 accurately corresponds to the precise time period that the valve 14 is open. The dispensing valve 14 is closed after the predetermined time period. The presentation of the carbonated beverage within the open container 44 is likely to be extremely repeatable because the temperature and the dispensing pressure of the carbonated beverage are tightly controlled. Other features of the system 10 described in connection with other Figures help to improve the repeatability of the presentation of the carbonated beverage in the open container.

Figure 4:
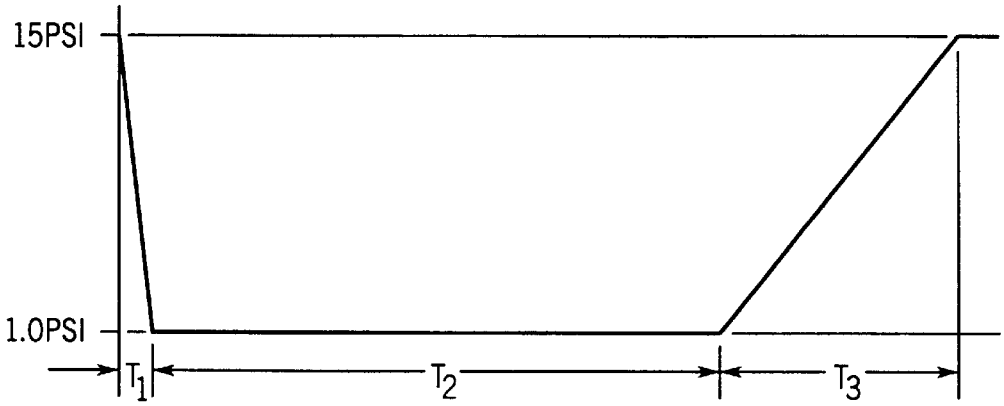
FIG. 4 is a graph illustrating the pressure of the carbonated beverage within the nozzle prior, during, and subsequent to dispensing the carbonated beverage from the nozzle into the open container.

FIG. 4 is a plot illustrating the pressure of the carbonated beverage within the nozzle 16 as a function of time over the course of a dispensing a cycle. FIG. 4 shown by way of example that the pressure of the carbonated beverage within the nozzle 16 at time T=0, (i.e. before the dispensing cycle) is 15 psi. As shown in FIG. 4, the pressure of the carbonated beverage in the nozzle is reduced from 15 psi to 1 psi prior to dispensing the carbonated beverage from the nozzle. The time period designated $T_1$ in FIG. 4 shows the pressure drop of the carbonated beverage within the nozzle form 15 psi to 1 psi. As mentioned, this occurs immediately before the valve 14 is opened. Once the pressure in the nozzle 16 is reduced to the desired dispensing pressure, i.e. 1 psi in FIG. 4, the valve 14 is opened to dispense the carbonated beverage. In FIG. 4, the valve 14 is opened during the time period designated $T_2$. Note that FIG. 4 shows that the pressure during the time period $T_2$ is a constant pressure which in many applications is preferred, however, is not strictly necessary. At the end of the time period $T_2$, the valve 14 is closed. The pressure on the carbonated beverage within the nozzle 16 and the chamber 30 recovers during time period $T_3$. In the system 10 shown in FIGS. 1 and 2, the elastomeric bladder 48 is allowed to relax to the home position shown in FIG. 1 during time period $T_3$ after the valve 14 is closed. Subsequent dispensing cycles are not typically initiated until the pressure of the carbonated beverage within the nozzle 16 and the chamber 30 is fully recovered, however, this is not necessary (e.g., the bladder operation is controlled in response to the signal from the pressure transducer 29). It may be important to properly adjust the flow restriction device 51 in order to achieve constant or nearly constant pressure during the time period $T_2$. That is, depending on the overall volume of the chamber 30 and nozzle 16, an inadequate flow restriction 51 may allow a premature pressure rise in the nozzle 16 before it is time to close the valve 14. An inadequate flow restriction 51 can be overcome by modulating bladder actuator 50.

Figure 3:
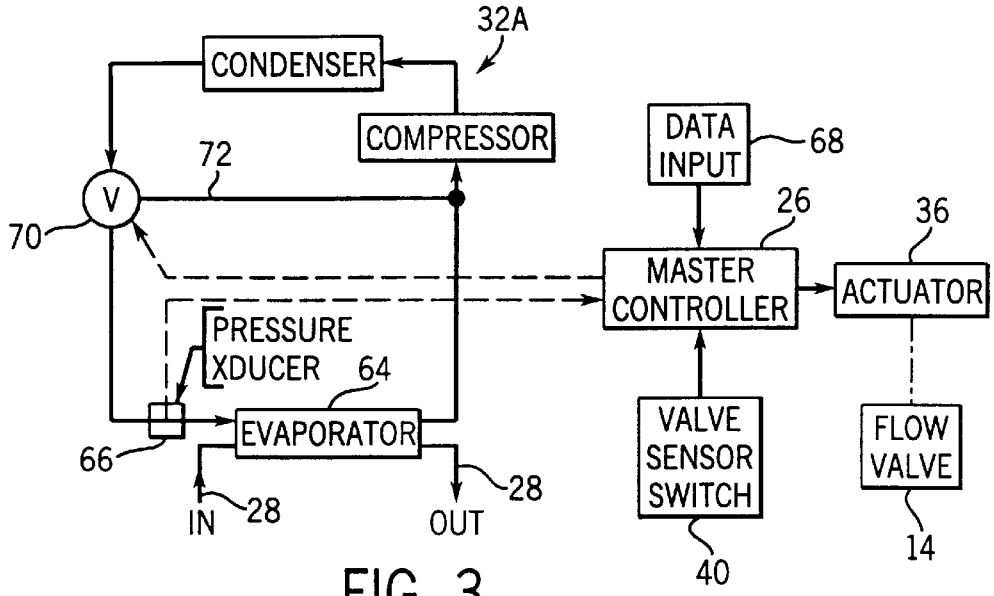
FIG. 3 is a block diagram illustrating the preferred electronic control system for the system shown in FIGS. 1 and 2.

FIG. 3 is a schematic drawing showing the preferred chiller system 32A, which is referred to herein as the zero$\Delta$T chiller 32A. In FIG. 3, the pressurized line 28 from the source of pressurized carbonated beverage flows through the evaporator 64. The evaporator 64 is preferably a flooded, freon-bath heat exchanger, although other conventional heat exchangers such as tube-in-tube heat exchangers may be suitable. The preferred flood freon-bath heat exchanger 64 is sized so that, under all normal operating conditions, the heat exchanger 64 has sufficient chilling capacity in order that the temperature of the carbonated beverage flowing from the evaporator 64 matches the temperature of the freon bath. In this manner, the temperature of the pressurized carbonated beverage flowing into the chamber 30 and the nozzle can be precisely determined by the temperature of the freon bath. The temperature of the freon bath in the evaporator 64 is monitored by a pressure transducer 66 which transmits a signal to the electronic controller 26. Block 68 in FIG. 3 which is labeled data input illustrates that the desired temperature of the carbonated beverage can be input as data into the controller 26, e.g., through a keypad or from electronic memory, etc. In turn, the controller 26 adjusts the position of valve 70 to change the pressure in the flooded, freon-bath of the evaporator 64 in order to obtain the desired temperature for the freon-bath. The valve 70 shown in FIG. 3 is a three-way valve. The primary purpose of valve 70 is that of an expansion valve in the freon refrigeration cycle. However, valve 70 can be adjusted so that a portion or all of the freon flowing to the valve 70 bypasses the evaporator 64 and flows directly through line 72 to the compressor. Typically, it is desirable to bypass the evaporator 64 entirely when the system 10 is in stand-by mode (i.e., hot gas by-pass), and there is no carbonated beverage 28 flowing through the evaporator heat exchanger 64. Utilizing such a bypass during stand-by mode is preferable to turning off power to the compressor because compressor start up times are significant and compressor duty life is severely shortened by repeated starting and stopping.

Figure 5:
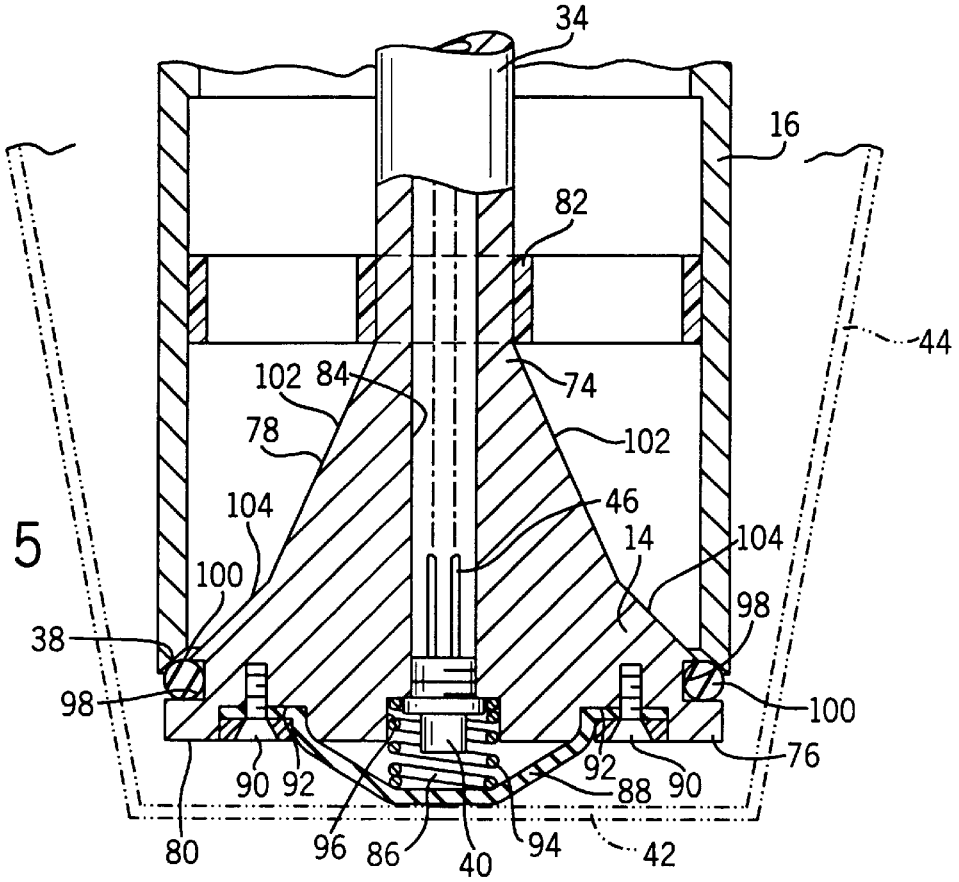
FIG. 5 is a detailed view of the region designated in FIG. 1 by arrow 5—5 which illustrates a preferred embodiment of the valve head incorporating a bottom activation switch.
Figure 6:
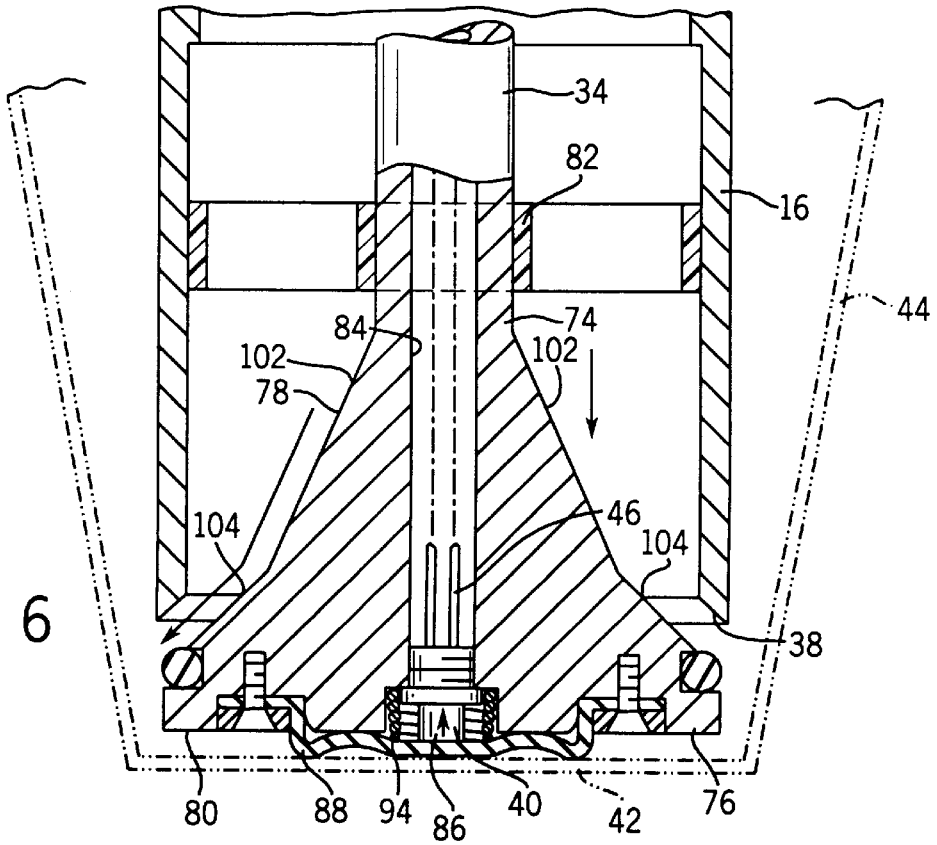
FIG. 6 is a view similar to FIG. 5 showing the bottom activation switch being actuated and the valve open in order to dispense carbonated beverage from the nozzle into the open container.

Referring now to FIG. 5 and 6, it may be desirable to provide a valve head 14 with a bottom activation switch 40. The valve head 14 has a proximal end 74 that is attached to the valve stem 34, and a distal end 76. The diameter of the valve head 14 at the proximal end 74 is less than the diameter of the valve head at the distal end 76 as is apparent from FIGS. 5 and 6. The valve head 14 includes a distribution surface 78 that contacts the carbonated beverage as it is stored in the nozzle 16 and as it flows through the outlet port 38 of the nozzle 16. The valve 14 also includes a base surface 80 that is generally horizontal along the distal end 76 of the valve 14. The valve head 14 is preferably made of stainless steel, and can be an integral component with the valve stem 34, although this is not necessary for implementing the invention. A star-shaped hub 82 aligns the valve stem 34 within the nozzle 16. It is desirable that the valve stem be accurately aligned in order for the dispensing carbonated beverage to form a full 360° curtain having substantially symmetric thickness. Inaccurate alignment will corrupt the symmetry of the curtain and result in sub-optimal dispensing. The stainless steel valve stem 34 and head 14 contains a longitudinal bore 84 that houses wires 46 which transmit signals from the activation switch 40. The activation switch 40 is preferably an optical sensor 86 that is glued into the bore 84 along the base surface 80 of the valve head 14 such that the sensor 86 extends downward beyond the base surface 80 of the valve head 14. An elastomeric seal 88 covers the switch 40 and is secured to the base surface 80 of the valve head using fasteners 90. The fasteners 90 are counter sunk within groove 92 in the base surface 80 of the valve head. A spring 94 (or other elastic material) is located around the sensor 86 for the switch 40. In the embodiment shown in FIGS. 5 and 6, the sensor 86 as well as the spring 94 reside primarily within a central recess 96 on the base surface 80 of the valve head 14. In FIG. 5, the spring 94 provides biasing pressure against the seal 88, and the sensor 86 measures the distance to the seal 88 in the open position. In order to close the switch 40, the user pushes the open container 44 upward so that the bottom 42 of the container pushes upward against the seal 88 and the spring 94. The sensor 86 measures the distance to the seal 88 in the closed position as shown in FIG. 6, and control signals are transmitted through wires 46 to the electronic controller 26. In turn, the electronic controller 26 controls the opening and positioning of the valve head 14 with the respect to the outlet port 38 of the nozzle 16. If a waterproof optical sensor 86 is used, the seal 88 and spring 94 are not necessary. In a system using a waterproof optical sensor, the optical sensor measures the distance to the bottom of the open container, rather than the distance to the spring-biased seal.

Still referring to FIGS. 5 and 6, the valve head 14 includes a circumferential groove 98 that is located at the distal end 76 of the valve head between the distribution surface 78 and the base surface 80. An O-ring elastomeric seal 100 is placed in the circumferential groove 98. When the valve head 14 is closed, as shown in FIG. 5, it is important that the O-ring seal 100 seat against the nozzle 16 to form a tight seal that is capable of preventing the leakage of pressurized carbonated beverage. Note that in FIG. 5, the O-ring seal 100 seats directly against the outlet port 38 for the nozzle 16. In some applications, however, it may be desirable to have the O-ring seal 100 seat directly against an inside wall of the nozzle 16.

In many circumstances, such as the dispensing of malt beverages, it is desirable to greatly redirect the trajectory of the carbonated beverage more horizontally before dispensing. This is accomplished in accordance with the invention by using a valve head 14 in which the distribution surface 78 has a specialized geometry. In particular, a first portion of the distribution surface 102 near the proximal end 74 of the valve head 14 is sloped more steeply downward than a second portion 104 of the distribution surface 78 that is located closer to the distal end 76 of the valve head 14. With this geometry, the valve head 14 gently redirects the flow of carbonated beverage when it initially flows towards the valve head 14, yet continues to further redirect the flow at downstream portion 104 in order to achieve a more preferable dispensing trajectory.

FIGS. 7 and 8 show a slightly different embodiment 110 of the invention. It should be understood that various components of the system 10 shown on FIG. 1 such as the chiller, the source of carbon dioxide 20, and the source of carbonated beverage 18 are depicted generally by block 112 labeled "beverage" in FIG. 7. In the system 110 shown in FIG. 7, the adjustable flow control device 51 of FIG. 1 has been replaced by a fixed flow control restriction 5 1A. In addition, the chilled and pressurized carbonated beverage flows from line 28 through the fixed flow control restriction 51A directly into the chamber defined by the nozzle 16. The volume of carbonated beverage within the flow control nozzle 16 downstream of the flow control restriction 51A in FIG. 7 can be less than the volume of the open container. In the system 110 shown in FIG. 7, the valve head 14A is located within the nozzle 16 when the valve is closed as shown more specifically in the detailed view of FIG. 8. It is important that the O-ring seal 100A, FIG. 8, engage tightly against the inside surface 16A of the nozzle when the valve head 14A is in a closed position. Similar to the system 10 shown on FIG. 1, the system 110 shown in FIG. 7 has an electronically controlled valve actuator 36 that is connected to a valve stem 34 and controls the position of the valve head 14A. The system 110 also includes a vent valve 52A that is opened to initially fill the nozzle 16 with beverage.

One distinct difference between the system 110 shown in FIG. 7 and the system 10 shown in FIG. 1 is that the system 110 in FIG. 7 does not use an elastomeric bladder to reduce the pressure of carbonated beverage contained in the nozzle 16 prior to dispensing carbonated beverage from the nozzle 16. Rather, upon initiation of the dispensing cycle (e.g., the engagement of activation switch 40 against the bottom 42 of the open container 44), the electronic controller 26 transmits a control signal through line 56 to instruct the valve actuator 36 (e.g. a servo motor or pneumatic actuator) to move the valve head 14A downward within the nozzle 16 prior to opening the valve 14A. This operation is illustrated in FIG. 9. The phantom locations for the O-ring seal 100A depicted by reference numerals 114 are an illustrative home location for the O-ring seal 10A. The valve 14A is located with the O-ring seal 100A in the home position 114 prior to the initiation of the dispensing cycle, and the carbonated beverage within the nozzle 16 is pressurized. Upon initiation of the dispensing cycle, the electronic controller instructs the valve actuator 36 to move the valve 14A downward so that the O-ring seal 100A is in an intermediate position identified by reference numbers 116. At this point in the process, the valve 14A is still closed inasmuch as the O-ring seal 100A prevents the dispensing of carbonated beverage from the outlet port 38A of the nozzle 16. The purpose of moving the valve head 14A from the home position 114 to the intermediate position of 116 is to slightly expand the size of the volume contained within the nozzle 16 and the flow restriction device 51A in order to reduce the pressure of the carbonated beverage within the nozzle 16. In this respect the system 110 operates substantially identically to the system 10 shown in FIG. 1. After the pressure has been reduced within the nozzle 16, the electronic controller 26 then opens that valve 14A, FIG. 9, in order to allow carbonated beverage to dispense through the outlet port 38A into the open container 44. Note that the combined volume within the nozzle 16 and the fixed flow control restriction 51A is probably smaller than the volume contained within the chamber 30 and nozzle 16 in the system 10 of FIG. 1. Therefore it may be necessary during the dispensing cycle in the system 110 shown in FIG. 7 to open the vent valve 52A momentarily in order to ensure that a proper dispensing pressure is achieved and maintained during the dispensing cycle.

FIG. 10 shows a system 210 in accordance with another embodiment of the invention. In system 210 shown in FIG. 10, the pressure of the carbonated beverage within the nozzle 16 is reduced prior to dispensing by a variable pressure valve illustrated as block 212. In system 210, when the bottom 42 of the open container 44 engages activation switch 40 to initiate a dispensing cycle, the electronic controller 26 transmits a control signal through line 214 to the variable pressure valve 212. FIG. 10 shows the variable pressure valve 212 located in pressurized line 28 upstream of the flow restriction device 51A, although it would be possible to locate the variable pressure valve 212 downstream of the flow restriction device 51A, or implement the system without the flow restriction device 51A. When the electronic controller 26 sends a signal to the variable pressure valve 212 indicating the initiation of the dispensing cycle, the variable pressure valve reduces the pressure within the nozzle 16. Thereafter, the dispensing valve 14 is opened as with the earlier systems 10 and 110. If necessary, the venting valve 52A can be opened during the dispensing cycle in order to ensure the appropriate dispensing pressure.

FIGS. 11A through 11C show three different valve head configurations. In FIG. 11A, the valve head 314 has a distribution surface 378 having a constant downward slope, i.e., is the shape of the valve head 314 in FIG. 11A is generally cone shape. An O-ring 300 seal is located within a circumferential groove between the distribution surface 378 and the base surface 380 as described above in connection with FIGS. 5 and 6. With the valve head 314 shown in FIG. 11A, the flow of carbonated beverage through the nozzle 16 is initially redirected in 360° as carbonated beverage impinges valve head 314 as depicted by arrow 382. In order to minimize undesirable turbulence and foaming when the carbonated beverage impacts the valve head 314, it is important that the slope of the distribution surface 378 be relatively steep in order to not agitate laminar flow. The trajectory of the carbonated beverage flowing along the valve head 314 as it dispenses into the open container 44 is generally in the direction represented by arrow 384 in FIG. 11A. With a beverage dispensing trajectory as represented by arrow 384, the trajectory distance for the carbonated beverage between the distribution surface 78 and bottom 42 of the open container 44 is given by the arrow X. The magnitude of distance X in FIG. 11A depends on the distance of the valve head 314 from the bottom 42 of the open container 44. The trajectory angle of arrow 384 has a relatively steep decent, however. With the valve head 314 in FIG. 11A, the carbonated beverage impacts the bottom 42 of the container 44 at a relatively abrupt angle when the valve head 314 is located close to the bottom 42 of the open container 44.

FIG. 11B shows a valve head 14 similar to that disclosed in FIG. 5. In valve head 14 shown in FIG. 11B and FIG. 5, the distribution surface 78 includes a first portion 102, and a second portion 104. Each portion 102, 104 is in the shape of the truncated cone. The slope of the distribution surface 78 of the first portion 102 descends more steeply than the slope of the distribution surface 78 of the second portion 104. When the carbonated beverage flowing through the nozzle 16 initially impinges the first truncated cone portion 102 of the valve 14, the flow of carbonated beverage is redirected in accordance with arrow 482. As the carbonated beverage adjacent the valve distribution surface 78 continues to flow along the valve distribution surface 78, it impinges the second truncated cone portion 104 which redirects the flow adjacent the valve 14 in accordance with arrow 484. In this manner, valve 14 gently redirects the flow of carbonated beverage twice in order to obtain a flow trajectory that is less steep than the valve head 314 shown in FIG. 11A. With the valve head 14 shown in FIG. 11B, the trajectory distance from the valve head distribution surface 78 to the bottom 42 of the open container 44 is given by arrow Y. Note that the magnitude of arrow Y in FIG. 11B is generally greater than the magnitude of arrow X shown in FIG. 11A because the trajectory angle of arrow 484 in FIG. 11B is more shallow than the trajectory angle of arrow 384 in FIG. 11A.

FIG. 11C shows a valve head 414 in which the slope of the distribution surface 478 becomes continuously less steep as the distribution surface 478 extends from the proximal end 474 to the distal end 476 of the valve head 414. When the carbonated beverage initially impinges the distribution surface 478, it is gently redirected as depicted by arrow 483, and it continues to be gently redirected to a less steep trajectory as illustrated by arrow 485. The magnitude of the arrow labeled Z in FIG. 11C designates the trajectory distance of the carbonated beverage as it leaves the distribution surface 478 before it hits the bottom 42 of the open container 44. Note that with the valve head configuration in FIG. 11C, it is possible that the trajectory of the carbonated beverage flowing from the valve head 414 be flatter than with the configurations shown in FIGS. 11B and 11A.

FIG. 12 through 14 illustrate a system 510 that has an automated container holder 512 is connected to a lifting actuator 514. The lifting actuator 514 moves the container holder 512 between a fully raised position designated by FRP in FIG. 12 and a down position designated DP in FIG. 12. The lifting actuator 514 is preferably driven by a servo motor or an electronically controlled pneumatic mechanism. The lifting actuator 514 receives a control signal from the electronic controller via line 516 in order to control the positioning of the container holder 512. To use the system 510, the user places the open container 44 on the platform while the platform is located in the down position DP, FIG. 12. The system is then actuated either by a push button, by barcode reading means as disclosed in U.S. Pat. No. 5,566,732, or other activation means. The activation signal is provided to the electronic controller 26 via line 518, FIG. 12. Upon receiving the activation signal, the electronic controller 26 initiates the dispensing cycle. This initiation involves the reduction of pressure of the carbonated beverage in the nozzle 16 as discussed previously. Also, a control signal is transmitted through line 516 to the lift actuator 514 to lift the container holder from the down position DP to the fully raised position FRP. When the container holder 512 is positioned in the fully raised position, FRP, FIG. 12, the bottom 42 of the open container 44 is located proximate to the outlet port of the nozzle 16. With the open container 44 in the fully raised position and the pressure appropriately reduced in the nozzle 16, the electronic controller 26 transmits a control signal through line 56 to valve actuator 36 to open the valve 14 and begin dispensing carbonated beverage into the open container 44. Referring to FIGS. 13 and 14, the system 510 is capable of lowering the container platform 512 as the open container 44 is being filled. It is desirable that the outlet port 38 remain submerged during the filling process (see FIG. 14). The positioning of the container holder 512 during the filling process is controlled by instructions from the electronic controller 26 via line 516 to the lifting actuator 514.

Figure 15:
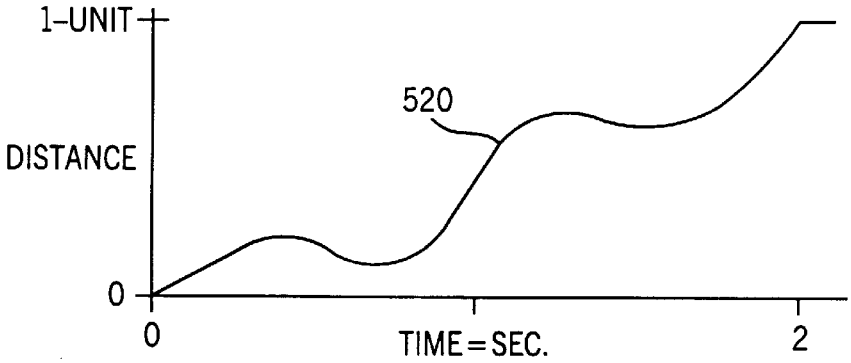
FIG. 15 is a graph illustrating a possible pouring profile for the systems shown in FIGS. 12–14 in which the Y-axis represents the relative distance of the bottom of the open container from the outlet port of the nozzle with respect to time during filling.

In order to achieve a desired presentation for the carbonated beverage within the filled open container 44, it may desirable to position the container holder during the filling process in accordance with a pre-selected electronic pouring profile. This feature is illustrated in FIG. 15. Still referring to FIGS. 12 and 13, the distance of the container holder 512 from the fully raised position, FRP, is displayed as a function 520 of time during an arbitrary filling cycle. The position of the curve 520 in FIG. 15 is referred to herein as the pouring profile. The pouring profile 520 is preferably stored electronically in memory that is accessible to the electronic controller 26. The pouring profile 520 in FIG. 15 assumes that it take 2 seconds to fill the container 44. As the container holder 512 moves from the fully raised position, FRP, at Time=0 to the down position, DP, at Time=2 seconds, intermediate motion rate and direction of the container holder 512 vary. In other words, while the open container 44 is being filled, the container may be lowered at slow rate, a fast rate, or may even be raised slightly in order to achieve the desired presentation.

In some applications, it may be desirable to selectively move and position the valve 14 with respect to the nozzle outlet port 38 while the carbonated beverage is dispensing from the nozzle 16. In these applications, the selective motion and positioning of the valve 14 during the dispensing of beverage is preferably accomplished in accordance with a predetermined dispensing profile, which is stored electronically in memory accessible to the electronic controller 26. In this manner, the electronic controller 26 can be programmed to cause the valve head 14 to flutter, or otherwise be selectively positioned and moved during the dispensing of carbonated beverage in order to vary dispensing flow characteristics.

Figure 16A:
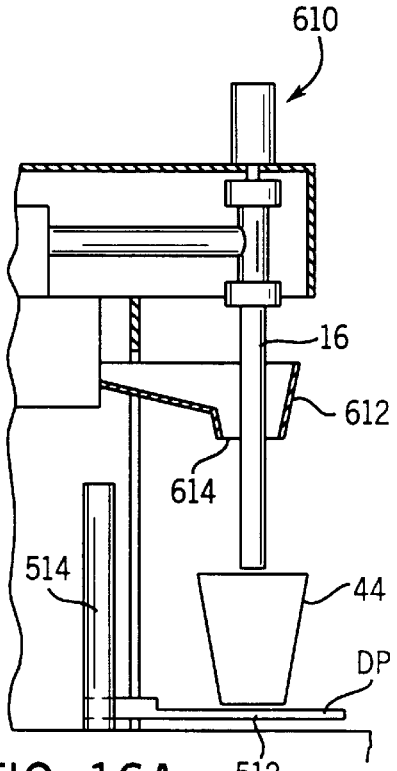
FIGS. 16A through 16D show the preferred manner of adding ice into an open container being filled with carbonated beverage.
Figure 16B:
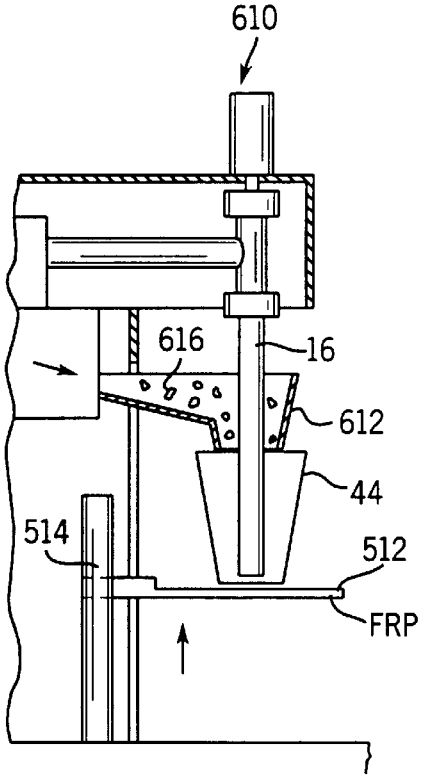
Figure 16C:
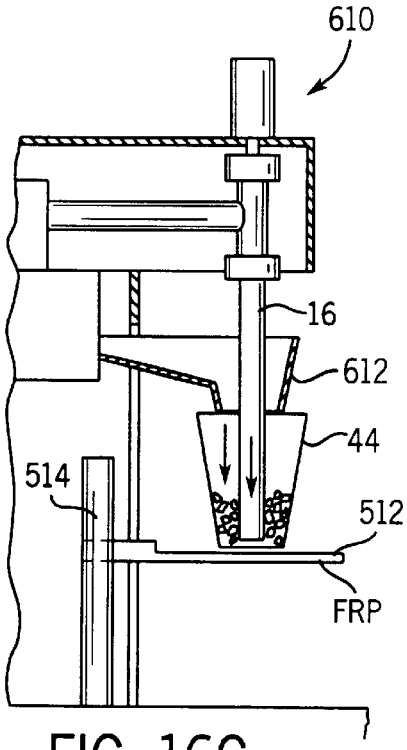
Figure 16D:
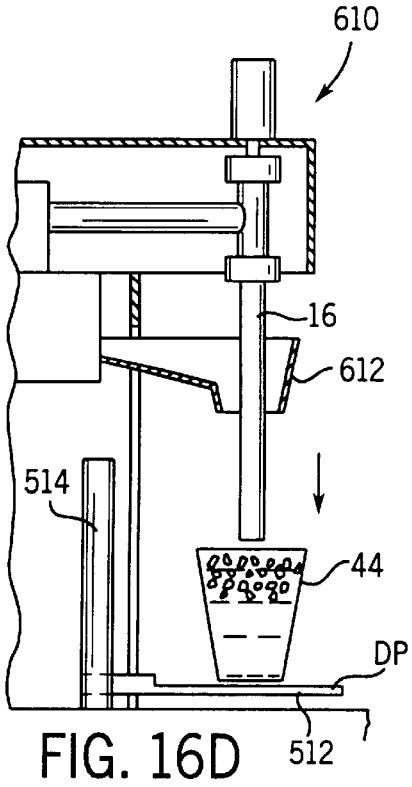

FIG. 16A through 16B illustrate a system similar to the system 510 shown in FIGS. 12 through 14, but further including a funnel 612 for adding ice 614 into the open container 44. The funnel 612 preferably has an outlet 614, through which the downwardly extending carbonated beverage nozzle 16 extends, such that ice is supplied circumferentially around the nozzle 16 into the open container, see FIG. 16B. The ice 616 is added to the open container 44 before dispensing the carbonated beverage into the open container 44 or contemporaneously with adding the carbonated beverage into the open container 44. As mentioned previously, it is important when adding carbonated beverage 12 and ice 616 into an open container 44 that the temperature of the carbonated beverage closely match the surface temperature of the ice 616 in order to reduce excessive foaming. While FIGS. 16A through 16B show the ice being added via a circumferential funnel 612, it is not necessary that the ice be added circumferentially. For example, the ice could be added to the container using a chute or some other means which does not circumvent the nozzle 16. Also, it would be possible to add the ice by hand, and still achieve efficient filling in accordance with the invention.

Referring to the specific apparatus shown in FIGS. 16A through *d*, the open container 44 is initially set into position on the container holder platform 512 with the platform in the down position DP as shown in FIG. 16A. The electronic controller 26 then instructs the actuator 514 to move the container holder 512 to the fully raised FRP as shown in FIG. 16B. Contemporaneously, the electronic controller 26 instructs the source of ice to discharge ice 616 into the funnel 612, and eventually into the open container 44 as shown in FIG. 16B and C. The funnel outlet 16 is sized slightly smaller than the typical opening for the container 44. The electronic controller 26 is programmed to dispense carbonated beverage into the open container 44 while the ice is falling into the container 44 or shortly thereafter. Preferably, the container holder 512 and the open container 44 are lowered during the filling process as depicted in FIG. 16B so that the open container 44 filled with ice and carbonated beverage is ready for service.

Alternatively, it may be desirable to partially fill the container with ice before adding the carbonated beverage. In this case, the nozzle 16 will not be placed into the open container to a bottom filling position, rather it is placed within the open container above the ice. In order to avoid excessive foaming, it is important that the carbonated beverage be chilled to a temperature substantially equal to the surface temperature of the ice that was added into the open container.

Figure 17:
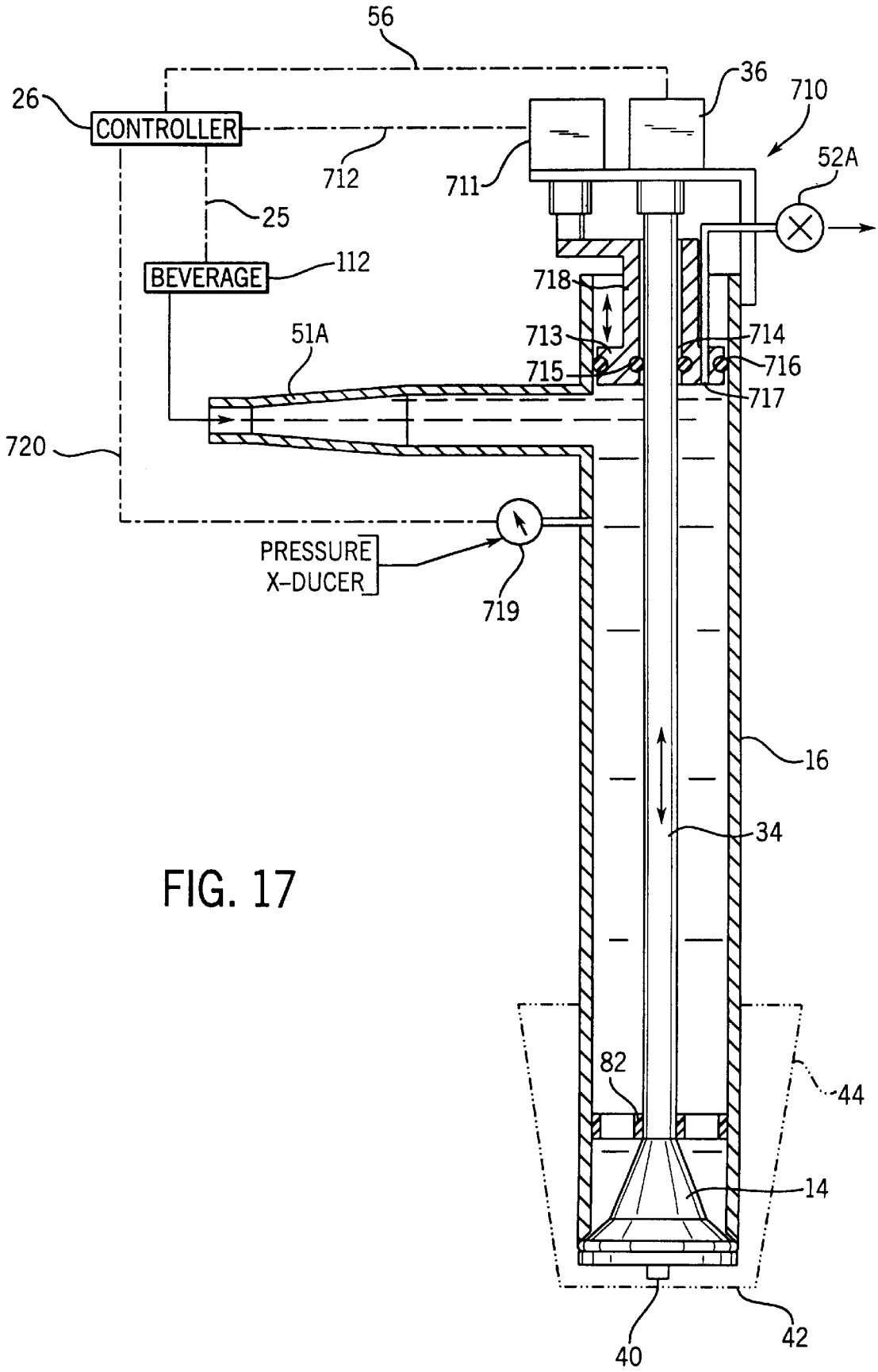
FIG. 17 is a schematic view of still another embodiment of the invention.

FIG. 17 illustrates a system 710 in accordance with still another aspect of the invention. The system 710 includes a second actuator 711 connected to the controller 26 by a line 712. The actuator 711 serves to vertically move a piston 713 disposed around the valve stem 34 within the nozzle 16 above the flow inlet to the nozzle 16. The piston 713 is generally circular in shape and includes a central opening 714 through which the valve stem 34 passes. To prevent the pressurized beverage from flowing upwardly past the piston 713, the piston includes a pair of O-ring seals 715 and 716. Seal 715 extends about the circumference of the central opening 714 in the piston 713 and engages the valve stem 34 to form a seal between the piston 713 and the valve stem 34. Seal 716 extends about the outer circumference of the piston 713 and engages the inner surface of the nozzle 16 to form a seal between the nozzle 16 and the piston 713. The piston 713 also includes a vent channel 717 extending through the piston 713 parallel to valve stem 34. The channel 717 is connected to a venting valve 52*a* on the exterior of the system 710. The pressure in the system 710 is monitored by a pressure transducer 719 located on the nozzle 16 and connected to the controller 26 by line 720. In operation, the nozzle 16 is filled with the carbonated beverage 112. Venting valve 52*a* allows the system to be purged of air during the filling process. After purging, the vent 52*a* is closed. The carbonated beverage fills the nozzle 16 until the desired beverage storage pressure is reached, as measured by transducer 719. In order to dispense the carbonated beverage, the controller 26 activates actuator 711 to raise shaft 718 and the piston 713 in order to decrease the pressure within the nozzle 16. When the pressure is sufficiently reduced within the nozzle 16 as measured by transducer 719, the controller 26 then initiates actuator 36 to move the valve stem 34 and valve head 14 downwardly to dispense the beverage into the open container 44. The transducer 719 continues to monitor the pressure of the carbonated beverage within the nozzle 16 during the pour. It is preferred that the controller 26 continues to transmit instructions to the piston actuator 711 to move the piston 713 during the pour in order to maintain an appropriate pressure within the nozzle 16 for pouring.

The invention has been described herein in connection with several embodiments, each including various features which may be desirable in various applications. It should be recognized that various alternatives and modifications of the invention are possible within the scope for the invention. Therefore, the scope of the invention should be interpreted by reviewing the following claims which particularly point out and distinctly claim the invention. Various alternatives and other embodiments are contemplated as being within the scope of the following claims which particularly point out and distinctly claim the subject matter regarded as the invention.

I claim:

1. A system for dispensing carbonated beverage into an open container comprising:

a source of carbonated beverage;

a downwardly extending nozzle which is adapted to dispense carbonated beverage into an open container such that an outlet port for the nozzle is in close proximity to a bottom of the open container when dispensing of the carbonated beverage is initiated;

a valve that controls the flow of carbonated beverage dispensing from the nozzle into the open container;

a valve actuator that positions the valve with respect to the outlet port of the nozzle;

an ice dispensing system which dispenses ice into the open container when the nozzle is located such that the outlet port of the nozzle is in close proximity with the bottom of the open container;

an activation sensor that outputs an activation signal; and an electronic controller that receives an activation signal and outputs a signal to control the valve actuator in order to initiate dispensing of the carbonated beverage from the nozzle into the open container.

2. A system as recited in claim 1 wherein the ice dispenser comprises a funnel having an outlet through which the downwardly extending carbonated beverage nozzle extends such that the ice is supplied circumferentially around the nozzle into the open container.

3. A system as recited in claim 1 further comprising a chiller for chilling the carbonated beverage flowing from the source of carbonated beverage to the nozzle.

4. A system as recited in claim 3 wherein the chiller chills the carbonated beverage so that carbonated beverage dispensing from the nozzle into the open container is chilled to approximately a surface temperature of the ice.

5. A system as recited in claim 1 in which the open container is at least partially filled with ice before dispensing of the carbonated beverage into the open container is initiated.

* * * * *